US007648086B2

(12) United States Patent
Struck

(10) Patent No.: US 7,648,086 B2
(45) Date of Patent: Jan. 19, 2010

(54) NOZZLE DEVICE FOR USE IN A PAPER MACHINE, BOARD MACHINE, PULP DEWATERING MACHINE OR SIMILAR MACHINES

(76) Inventor: Hans-Joachim Bernd Struck, c/o Papiermaschinen-Systemtechnik GmbH Moltkestr. 1, 77654 Offenburg (DE)

( * ) Notice: Subject to any disclaimer, the term of this patent is extended or adjusted under 35 U.S.C. 154(b) by 477 days.

(21) Appl. No.: 11/136,312

(22) Filed: May 24, 2005

(65) Prior Publication Data

US 2006/0163389 A1 Jul. 27, 2006

(30) Foreign Application Priority Data

Dec. 24, 2004 (DE) ..... 20 2004 020 185 U

(51) Int. Cl.
*B05B 1/14* (2006.01)

(52) U.S. Cl. ..... 239/550; 239/552; 239/566; 239/591; 239/600; 239/DIG. 4; 81/436; 81/461

(58) Field of Classification Search ..... 239/548, 239/550, 566, 580, 591, 600, DIG. 4, 552; 81/52, 436, 461
See application file for complete search history.

(56) References Cited

U.S. PATENT DOCUMENTS

| | | | | |
|---|---|---|---|---|
| 4,660,773 | A * | 4/1987 | O'Hanlon | 239/600 |
| RE32,840 | E * | 1/1989 | Bingham | 239/600 |
| 5,333,841 | A * | 8/1994 | Showalter et al. | 239/552 |
| 5,454,515 | A * | 10/1995 | Perret, Jr. | 239/600 |

* cited by examiner

*Primary Examiner*—Steven J Ganey
(74) *Attorney, Agent, or Firm*—Harness, Dickey & Pierce, P.L.C.

(57) ABSTRACT

The invention relates to a nozzle device for use in a paper machine, board machine, pulp dewatering machine etc., comprising a cylindrical body having an outer thread and an inner hexagon socket; a sealing element, and a nozzle insert having a cylindrical passage. The cylindrical body, the sealing element and the nozzle insert are preferably formed as a single part.

7 Claims, 3 Drawing Sheets

NOZZLE DEVICE FOR USE IN A PAPER MACHINE, BOARD MACHINE, PULP DEWATERING MACHINE OR SIMILAR MACHINES

FIELD OF THE INVENTION

The present invention relates to a nozzle device for use in a paper machine, board machine, pulp dewatering machine, or similar machines.

BACKGROUND OF THE INVENTION

Shower pipes are generally known and are used in paper machines for cleaning fabrics, press felts, roll covers, suction rolls, etc. There are various designs regarding the manner in which the nozzles are fitted. Certain shower pipes comprise a plurality of nozzle devices which are equally spaced along the longitudinal axis of the pipe and each nozzle device itself comprises a cylindrical body having an outer thread and an inner hexagon socket, a gasket element and a disk-like nozzle insert with a cylindrical passage or channel. To mount the nozzle devices at the shower pipe, the shower pipe comprises threaded openings in which the gasket element and the nozzle insert are inserted and fixed by screwing the cylindrical body into the opening. In FIG. 6 of the attached drawings, a known shower pipe is shown.

During operation of the shower pipe, it is supplied with water at high pressure which passes through the cylindrical passages of the nozzles toward the fabrics, press felts, etc. to be cleaned.

In FIGS. 4 and 6 of the attached drawings, the nozzle device of the prior art is shown in detail. As already mentioned, the known nozzle device comprises a cylindrical body which is provided as a threaded retainer ring 3, a gasket element 4 and a nozzle insert which is provided as a nozzle disc 5.

The nozzle device comprised of these three elements is fixed at the shower pipe 1 within a threaded opening 2. Particularly, for mounting the nozzle device it is first necessary to insert the gasket element 4 which is supported by an annular flange within the opening 2. Second, the nozzle disc is inserted and third, the unit of gasket and nozzle disc is fixed with the retainer ring 3 screwed into the opening 2. Hence, the nozzle disc 5 is sandwiched between the gasket element and the retainer ring. For screwing the retainer ring, it is provided with a hexagonal socket. As to allow a 110° fan jet, as shown in FIG. 4, the socket has a limited depth.

Due to this limited depth of the retainer ring, it is difficult to guarantee a secure engagement with an Allen key, particularly in cases where the retainer ring has to be unscrewed after a long period of operation.

A further disadvantage of the nozzle devices as shown in FIGS. 4 and 6 is that it is difficult for the mechanic installer to handle the three parts of the nozzle device. This disadvantage is of particular concern as the shower pipe extends along the total width of a felt of a paper machine and, therefore, comprises a great number of such nozzles. The effort to install all these nozzles or to change them is substantial. Objects lost in the machine represent a significant danger of extensive damage during startup or operation of the machine.

A further problem with the known nozzle devices is that the risk that an element of the nozzle device falls into the paper machine is high.

SUMMARY OF THE INVENTION

It is, therefore, an object of the present invention to provide a nozzle device and a shower pipe device which overcome the above-mentioned disadvantages.

The object underlying the present invention is solved by a nozzle device comprising a cylindrical body having an outer thread and an inner hexagon socket, a sealing element, and a nozzle insert having a cylindrical passage, wherein said cylindrical body, said sealing element and said nozzle insert are formed as a single part.

One of the advantages of the inventive nozzle device is a substantially improved handling, particularly with respect to the mounting process. In contrast to prior nozzle devices, the inventive device may be screwed in easily, particularly when screwing overhead. The installer has to handle just one single part compared to three parts in prior devices.

Moreover, replacement of a nozzle device is also improved due to the fact that unscrewing the nozzle device removes all "functional elements" at once, even the sealing element, in contrast to prior devices where the gasket element was not automatically removed with removing the retainer ring.

In a preferred embodiment, the nozzle device comprises an inner groove adapted to engage one or two balls of a special hexagon socket screw key (also called Allen key).

This measure has the advantage that the Allen key with its spring-biased balls releasingly engages the groove, so that the nozzle device may be held by the Allen key.

This also means that the Allen key is securely held in the hexagon socket, so that the risk of slipping out of the socket is substantially reduced.

In a further preferred embodiment, said cylindrical body comprises an outside groove at its upper portion for improved holding of the body.

This groove provided at the outside of the cylindrical body allows the installer to better grip and hold the body with the fingernails.

In a further preferred embodiment, said nozzle insert comprises corundum mono-crystal or other wear resistant orifice material adapted to be press-fitted into the cylindrical body. Alternatively, said corundum mono-crystal or other wear resistant orifice material is inserted into a liner and said liner is press-fitted into said cylindrical body or said corundum mono-crystal insert is secured using a two-component adhesive resin.

In a further preferred embodiment, the ratio of the diameter of said passage in the nozzle insert and the length of said passage is 1:2 or less, meaning that the length of the passage is not greater than two diameters.

This ratio has been proven advantageous, particularly with respect to the required high degree of laminarity of the produced water jet.

The above-mentioned object is also solved by a shower pipe device for use in a paper machine, particularly for cleaning fabrics, press felts, roll covers, suction rolls, etc. of a paper machine with high pressure water showers, comprising a shower pipe having at least one threaded opening and at least one inventive nozzle device, wherein said nozzle device is screwed into said threaded opening.

More preferably, a plurality of threaded openings equally spaced and aligned relative to the longitudinal axis of the pipes is provided and each opening is provided with a respective nozzle device according to the present invention.

Further features and advantages can be taken from the following description and the enclosed drawing.

It is to be understood that the features mentioned above and those yet to be explained below can be used not only in the respective combinations indicated, but also in other combinations or in isolation, without leaving the scope of the present invention.

BRIEF DESCRIPTION OF THE DRAWINGS

An embodiment of the invention is shown in the drawings and will be explained in more detail in the description below with reference to same.

DETAILED DESCRIPTION OF A PREFERRED EMBODIMENT

Figure 1:
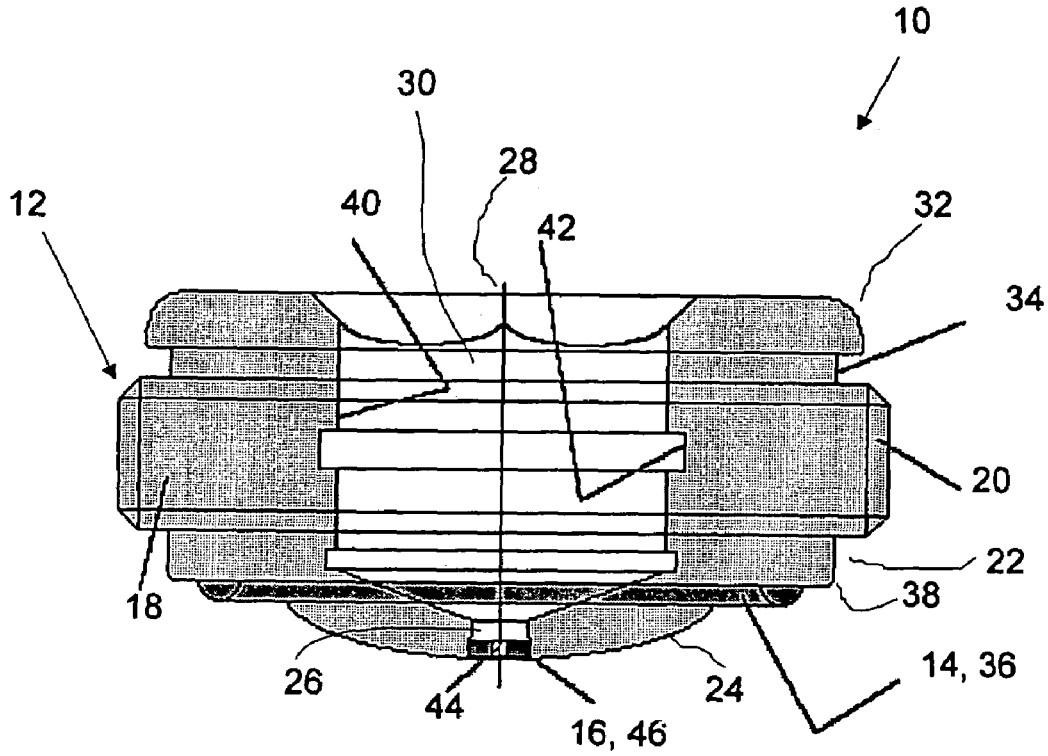
FIG. 1 is a cross-sectional view of a nozzle device according to the present invention.

In FIG. 1, a nozzle device is schematically shown in a cross-sectional view and is indicated with reference numeral 10. The nozzle device 10 is used for generating a laminar water jet used for cleaning purposes in a paper machine, board machine, pulp dewatering machine etc.

The nozzle device 10 is provided as a rotationally symmetrical body made of a metal, preferably stainless steel. The body 12 incorporates at least three functional elements, namely a sealing element 14, a nozzle element 16 and a threaded ring portion 18. These three functional elements are integrally formed and may be handled as one single part due to the structural inventive design which will be described below.

The threaded ring portion 18 forming the central longitudinal portion of the body 12 has an outside thread 20 which is adapted to engage an inside thread provided in a shower pipe.

In one longitudinal direction, an inner end portion 22 follows the threaded ring portion 18. The inner end portion having a diameter less than that of the threaded ring portion 18 leads to a spherical portion 24. The spherical portion 24 has a bore 26 in line with the longitudinal axis 28 of the nozzle device 10 and extending through the spherical portion 24.

The bore 26 leads into a bore 30 of a greater diameter which extends from the bore 26 to the opposite end of the body 12. This opposite end is formed of a longitudinal end portion 32 which has an outer diameter a little bit smaller than the diameter of the threaded ring portion 18.

The longitudinal end portion 32 comprises a portion with a smaller diameter, so that an annular groove 34 is formed between the threaded ring portion 18 and the end portion 32. This annular groove 34 serves to improve the handling of the nozzle device 10. Particularly, this groove 34 allows to hold the nozzle device 10 securely with the fingernails.

The sealing element 14 is provided as an O-ring 36 recessed in an outer surface of the inner end portion 22 which is perpendicular to the longitudinal axis 28. As shown in FIG. 1, the O-ring 36 surrounds the spherical portion 24 of the inner end portion 22.

Figure 2:
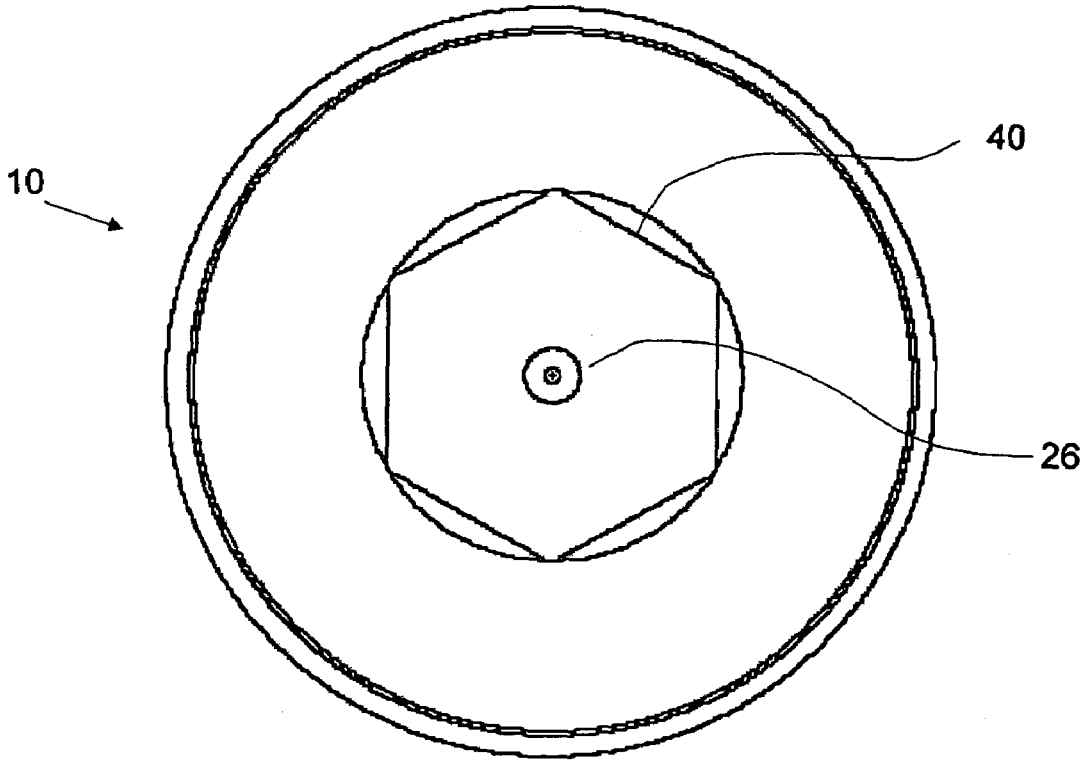
FIG. 2 is a top view of the nozzle device of FIG. 1.

The bore 30 comprises a hexagon socket 40 which may also be seen in FIG. 2. The hexagon socket 40 is used to screw or unscrew the nozzle device 10 by means of an Allen key 60 which is shown schematically in FIG. 3.

Within the hexagon socket 40 and the threaded ring portion 18, a groove 42 is provided. The groove 42 is adapted such that spring biased balls 62 (see FIG. 3) of the Allen key 60 are allowed to snap in as to lock the Allen key 60 within the hexagon socket 40 in a longitudinal direction.

This measure has the advantage that the nozzle device 10 is held at the Allen key 60 and may, hence, not fall down during a screwing or unscrewing operation.

It is apparent from FIG. 1 that the hexagon socket 40 has a relatively long longitudinal extent which allows a very secure engagement of the Allen key 60 and, hence, enables to apply very high torques.

A further advantage of the length of the hexagon socket 40 is that any tilting or jamming of the Allen key 60 in the hexagon socket may be avoided. Rather, the Allen key 60 is securely guided in the hexagon socket 40.

In order to produce a laminar jet, the nozzle element 16 comprises a passage or channel 44 passing therethrough which is aligned with the longitudinal axis 28. The diameter of this passage 44 is in the range of 1.5 mm or less and has a longitudinal length approximately two times of the diameter or less. Hence, the ratio of the diameter of the channel 44 and its length is approximately 1:2 or less. A typical example would be a diameter of 0.8 mm and a cylinder length of 1.0 mm.

The nozzle element 16 is provided as a small plate 46 made of a corundum mono-crystal, preferably ruby or other wear resistant orifice material. The nozzle plate 46 is preferably press-fitted into the bore 26 of the spherical portion 24. However, it is also possible to insert the nozzle plate 46 in a liner or sleeve which, in turn, is press-fitted into the bore 26. Alternatively, the nozzle plate 46 is secured in the bore 26 using a two-component adhesive resin.

It is to be seen that the nozzle plate 46 and, particularly, the cylindrical channel 44 does not have any significant chamfer or curvature at the inner or outer edge of the channel 44.

Figure 3A:
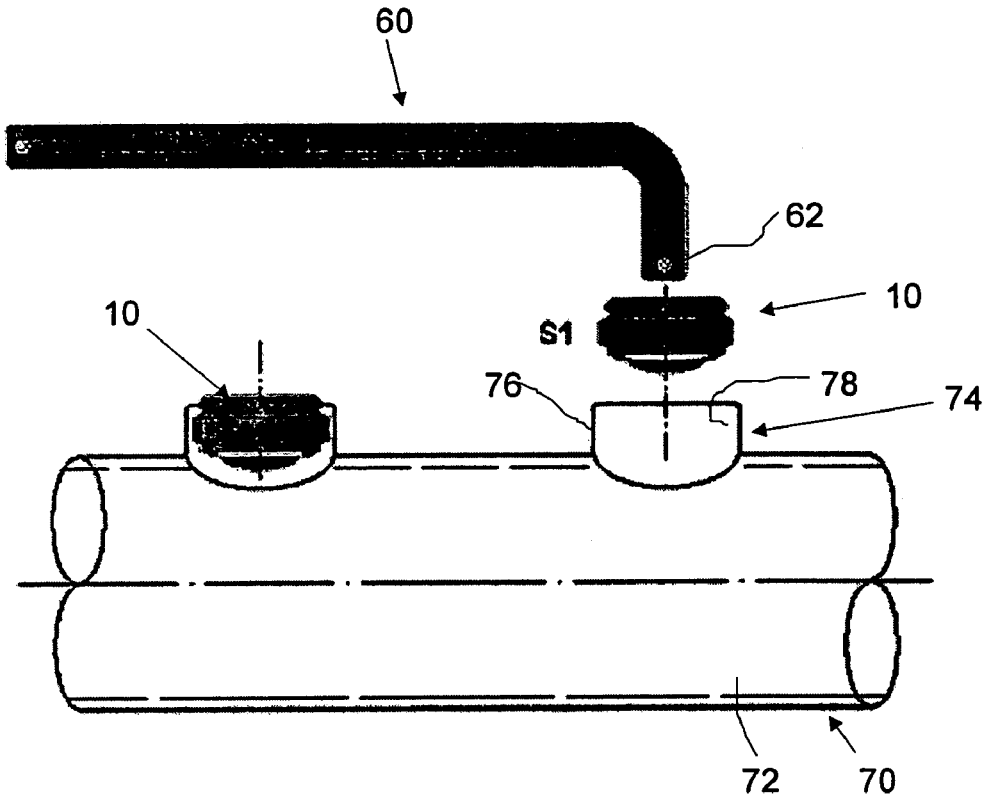
FIG. 3A is a schematic view of a part of a shower pipe with one inventive nozzle device being screwed in and one inventive nozzle device being prepared for screwing in by use of an Allen key.

Referring to FIG. 3A, a longitudinal section of a shower pipe device 70 is schematically shown. The shower pipe device 70 comprises a pipe 72 having a plurality of openings 74, each allowing a fluid communication between the inside of the pipe and the outside. The openings 74 are equally spaced and are aligned along the longitudinal axis of the pipe 72.

Each opening 74 has a collar portion 76 with an inside thread 78. This inside thread 78 is adapted to engage the outside thread 20 of the nozzle device 10. Hence, the nozzle device 10 may be screwed into the opening 74 by use of the Allen key 60.

Within the opening 74, a flange surface is provided (not shown in the Figures) at which the nozzle device 10 with the O-ring 36 abuts. Therewith, the opening 74 is sealed so that fluid, preferably water, can only flow through the passage or channel 44 of the nozzle plate 46 from the pipe 72 to the outside.

Figure 3B:
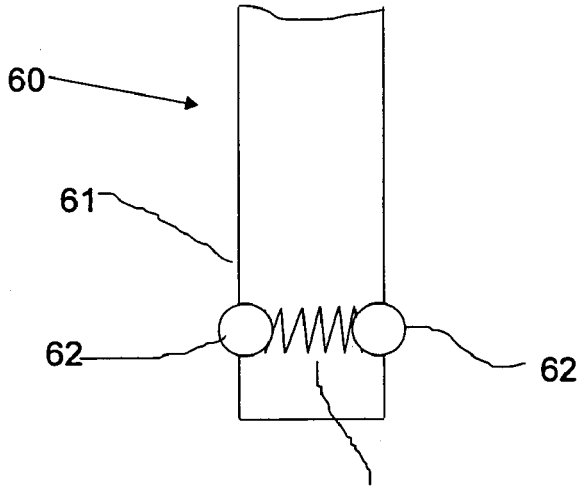
FIG. 3B is a schematic view of a part of the Allen key.
Figure 4:
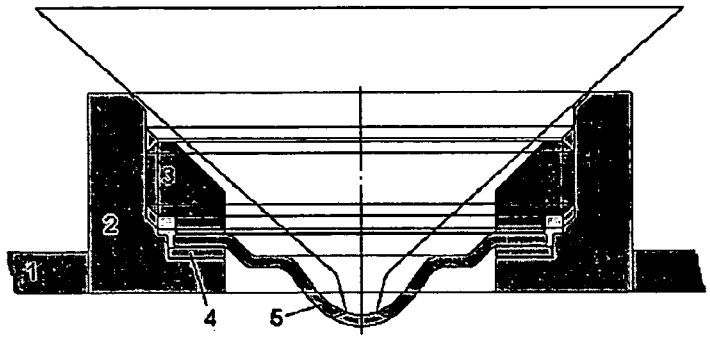
FIG. 4 (PRIOR ART)
FIGS. 4 to 6 are schematic views of prior art nozzle devices and a shower pipe.
Figure 5:
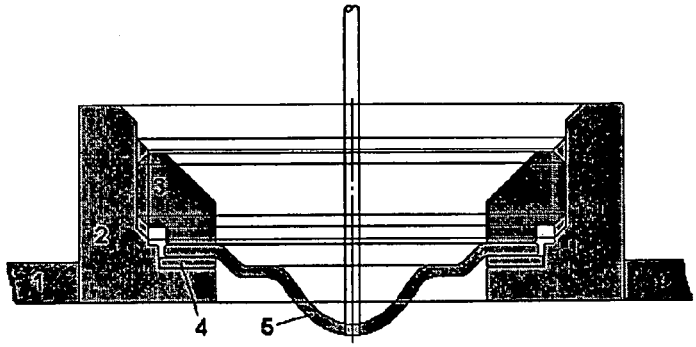
FIG. 5 (PRIOR ART)
Figure 6:
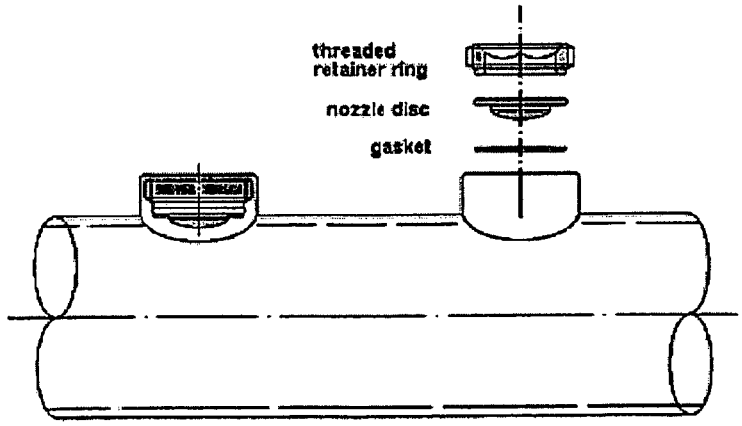
FIG. 6 (PRIOR ART)

Referring to FIG. 3B, the Allen key 60 is specially adapted to the inventive nozzle device 10 and comprises preferably two balls 62 within a longitudinal engagement portion 61. The balls 62 are biased by a spring 63 in a direction perpendicular to the longitudinal axis of the engagement portion.

Briefly summarized, the present invention provides a nozzle device which may be handled much more easily than prior devices. Particularly, the nozzle device formed as a single part substantially reduces the manual steps for screwing and unscrewing the nozzle devices 10 and reduces the risks of accidents by parts lost in the machine during the assembly or disassembly procedure.

Therefore, what is claimed, is:

1. Nozzle device for use in a paper machine, board machine, or pulp dewatering machine, comprising:

a cylindrical body having an outer thread and an inner hexagon socket;

a sealing element, and a nozzle insert having a cylindrical passage, wherein said cylindrical body, said sealing element and said nozzle insert are formed as a single part;

wherein said inner hexagon socket comprises an inner groove extending in a circumferential direction that is adapted to engage a ball of a hexagon socket screw key.

2. Nozzle device as claimed in claim 1, wherein said cylindrical body comprises a groove at its upper portion for improved holding of the body.

3. Nozzle device as claimed in claim 1, wherein said nozzle insert comprises corundum mono-crystal or other wear resistant material adapted to be press-fitted into the cylindrical body.

4. Nozzle device as claimed in claim 1, wherein the cylindrical body has a central bore formed therein that communicates with the cylindrical passage of the nozzle insert.

5. Nozzle device as claimed in claim 4, wherein said inner hexagonal socket and said central bore are formed coaxially within said cylindrical body.

6. Nozzle device as claimed in claim 5, wherein said inner hexagonal socket extends substantially the entire axial length of said central bore.

7. An Allen key for screwing into a fluid conduit a nozzle device comprising a cylindrical body having an outer thread and an inner hexagonal socket with an inner groove, the allen key comprising a longitudinal engagement portion for engagement with the inner groove of the inner hexagon socket of said nozzle device, wherein said engagement portion comprises at least one ball being spring-biased in a direction perpendicular to the longitudinal axis of the engagement portion.

* * * * *